US007513334B2

(12) United States Patent
Calver

(10) Patent No.: US 7,513,334 B2
(45) Date of Patent: Apr. 7, 2009

(54) POWERED ROPE CLIMBING APPARATUS

(75) Inventor: Trever Calver, Basingstoke (GB)

(73) Assignees: Nicholas Woodliffe Browne, Hampshire (GB); Trevor John Calver, Hampshire (GB)

( * ) Notice: Subject to any disclaimer, the term of this patent is extended or adjusted under 35 U.S.C. 154(b) by 193 days.

(21) Appl. No.: 11/188,289

(22) Filed: Jul. 22, 2005

(65) Prior Publication Data

US 2006/0017047 A1 Jan. 26, 2006

Related U.S. Application Data

(63) Continuation of application No. PCT/GB2004/000301, filed on Jan. 23, 2004.

(30) Foreign Application Priority Data

Jan. 24, 2003 (GB) ..... 0301725.8

(51) Int. Cl.
*A63B 27/00* (2006.01)

(52) U.S. Cl. ..... 182/133

(58) Field of Classification Search ..... 182/192, 182/133, 142, 140; 254/411, 342, 371, 372
See application file for complete search history.

(56) References Cited

U.S. PATENT DOCUMENTS 3,915,432 A * 10/1975 Bustamante ..... 182/239
3,944,185 A 3/1976 Evans
3,991,979 A 11/1976 Mauldin
4,623,036 A 11/1986 Pondorfer
6,109,633 A 8/2000 Schweizer
6,412,602 B1 7/2002 Sundman

FOREIGN PATENT DOCUMENTS

| | | |
|---|---|---|
| DE | 1481901 | 5/1969 |
| DE | 120410 | 6/1976 |
| GB | 0612084 | 8/1976 |
| WO | WO 99/24122 | 11/1998 |

* cited by examiner

*Primary Examiner*—James O Hansen
(74) *Attorney, Agent, or Firm*—Lawrence G. Fridman

(57) ABSTRACT

Portable power driven rope climbing apparatus having a motor driving a gear reduction mechanism which drives a pulley wheel securing a rope extending thereabouts. A rope output guide member is provided for maintaining the rope in engagement with the pulley wheel an attachment mechanism for attaching an external load. The attachment mechanism comprises a rope entry guide member for supporting a rope as it enters the apparatus, so as to provide a fulcrum point about which the mass of the apparatus exerts a first moment. The attachment mechanism further comprises a seat member for supporting the load. The seat member is held remote from the main body such that the load, when mounted thereon exerts a second, opposed moment about the fulcrum.

31 Claims, 5 Drawing Sheets

POWERED ROPE CLIMBING APPARATUS

THIS APPLICATION IS A CONTINUATION OF PCT INTERNATIONAL APPLICATION PCT/GB/2004/000301 FILED Jan. 23, 2004 WHICH IS CURRENTLY PENDING AND CLAIMS PRIORITY OF GREAT BRITAIN PATENT APPLICATION GB 0301725.8, FILED Jan. 24, 2003.

BACKGROUND OF THE INVENTION

The present invention is directed to a powered rope climbing apparatus and, more particularly to a portable device which may engage and automatically climb a rope whilst allowing an operator to connect themselves thereto to appropriately ascend or descend a rope using such apparatus.

Rope climbing, whether professionally or recreationally can be extremely arduous and potentially dangerous and therefore numerous labour saving and safety devices have been developed to assist the climber. For example, many specialised rope clamps and pulleys have been developed for both recreational and professional climbing which may be attached to the users harness and also to the rope which allows the user to selectively move these harnesses and clamps along the rope or to lock them in engagement with the rope when he wishes to be restrained from descent therealong. These devices may be automatically or manually operable to engage with the rope. However, whilst such devices have considerably enhanced accessibility of rope climbing to both skilled and un-skilled persons, the primary physical effort necessary to propel a climber up or down a rope is maintained. In particular, for professional rope climbers who, through necessity of their jobs, must constantly ascend and descend the ropes (ie. for inspection or maintenance in inaccessible areas) this can be highly energy sapping and thus limit their operational ability. Secondly, where additional material or additional bodies need to be carried by a climber (in the event of a rescuer) then the workload is significantly increased. In addition, whilst traditional winches or hoists have been employed to take advantage of a power source to lower or raise an appropriate body or person suspended on a rope to enable them to ascend or descend to an inaccessible position, such devices are significantly limited in their operation due to their mass and necessity to be attached to a secure anchor point (often necessitating bolting or other securely fixing). A further drawback of such traditional hoists and winches is that they cannot be releasably connected along a length of rope, but instead a rope must be threaded end first through the mechanism significantly restricting the application of these devices to assist a user and restricting their ability to be connected to any part of a rope, particularly to the midpoint of a suspended rope.

It is therefore an object of the present invention to provide a powered rope climbing device which alleviates the aforementioned problems and which is portable.

SUMMARY OF THE INVENTION

According to one aspect of the invention there is provided a portable power driven rope climbing apparatus comprising a main support body; a power driven rotational input means mounted on said body; a drive shaft mounted on said body having a main pulley wheel co-axially mounted thereon; a gear reduction mechanism for transmitting a rotational force between said input means and said drive shaft; said main pulley wheel comprising engaging means for securely engaging a rope extending thereabouts such that rotation of said pulley wheel effects displacement of said rope; a rope input guide member and a rope output guide member for maintaining said rope in engagement with said pulley wheel about the majority of the pulley wheel circumference; and an attachment mechanism mounted on said main support body for releasably mounting an external load thereon, said attachment mechanism comprising a rope entry guide member for supporting a rope as it enters the apparatus, which entry guide member providing a fulcrum point about which the mass of the apparatus exerts a first moment, and wherein said attachment mechanism further comprises a seat member for supporting said load, said seat member being held remote from said main body such that said load, when mounted thereon, exerts a second, opposed moment about said fulcrum.

In its preferred form, the apparatus will comprise an electrical motor for driving the rotational input means.

Preferably, the motor is controlled to drive the input means in a first direction to transmit a rotational force through the gear reduction mechanism and to rotate the main pulley wheel in a first rotational direction to effect displacement of the apparatus along the rope in a first direction, usually to ascend a rope, wherein displacement of the apparatus along the rope in an opposite direction, such as when descending under the influence of gravity, will cause the pulley wheel to be rotated in a second opposite direction thereby reversing the rotational direction of the input means via the gear reduction mechanism, so as to adapt the motor to form an electrical generator which is subsequently used for recharging the battery during descent. In this manner, the apparatus may utilize the battery to drive the motor for ascending purposes whereby descent can be controlled under the influence of gravity and the subsequent reverse rotation of the pulley wheel used as an input for an electrical generator for recharging purposes.

Preferably, the engagement means will comprise a circumferential V-shaped groove for frictionally engaging a rope compressed therein. The inwardly directed side walls of this V-shaped groove will usually define an angle of between 5 and 35, more often between 5 and 20 and, preferably, at a combined angle of 10.

This particular angular configuration of such a V-shaped groove has been found to compress a rope therein sufficiently to achieve sufficient frictional engagement therewith to maintain the rope within the pulley wheel. It is usual that the main pulley wheel will also have associated therewith an extractor member which is restrained from displacement relative to the pulley wheel and which extends into this V-shaped groove at a pre-determined position about its axis to engage and deflect the rope out of engagement with the groove during rotation of the pulley.

Due to the frictional forces achieved between the rope and the pulley to prevent slippage, it is thus necessary to use such an extractor member to ensure that the rope leaves the pulley at an appropriate position about its axis to prevent the rope becoming sequentially wound about the pulley wheel. The pulley wheel may further comprise rope gripping means on at least one, and preferably both, of its inwardly directed side walls of the V-shaped groove. Such gripping means may comprise a plurality of radially extending ridges and grooves, preferably such ridges and grooves having rounded apex to alleviate damage and potential cutting of the rope. Alternatively, or in addition, such gripping means may comprise a plurality of holes or recesses formed in the inner surface of the side walls into which the rope can flow as it becomes compressed in the V-shaped groove, thus increasing engagement between the pulley and the rope. The formation of such apertures or holes within the pulley walls further serves to reduce the overall mass of the pulley wheel and thus the mass of the apparatus itself.

Furthermore, the main pulley wheel may also comprise two separable disc members which can be secured together with at least one spacer element disposed therebetween to space apart the inwardly directed side walls of the V-shaped groove, the spacer element having a diameter less than half of the diameter of the two main disc members and being mounted coaxially therewith on the drive shaft.

In this manner, whilst the V-shaped groove is thus maintained with the same angle, the walls moved further apart to accommodate different diameter ropes or to allow rope of a uniform diameter to be drawn more deeply into this V-shaped groove, serving to reduce the necessary torque to lift a load supported thereon.

An alternative form of pulley wheel may comprise a series of radially extending arm members radiating outwardly from the drive shaft, whereby such arm members still maintain a V-shaped groove therebetween. Whilst such series of arms still maintain a V-shaped groove about the circumference of the pulley, the pulley wheel will be considerably lighter due to the removed material from between adjacent arms. Such a feature provides an additional advantage that as the rope is compressed into the V-shaped groove created between opposed sets of arms, the rope is also caused to flow, under pressure, into the space in between such adjacent areas so to further enhance the grip between the pulley wheel and such rope.

Preferably, the main support body of the apparatus will comprise a main chassis with a displaceable cover member releasably connected to this chassis such that the drive shaft may be operatively mounted between and supported by both the chassis and the displaceable cover member when the cover member is connected to such chassis. Due to the load to be borne by the pulley wheel in operation, then should the drive shaft only be supported at one end thereof, then a very rigid support chassis would be needed resulting in additional weight of the apparatus to support the drive shaft in this manner. However, by supporting the drive shaft at both ends by use of a displaceable cover alleviates this potential problem whereby the use of a displaceable cover is beneficial in allowing connection of the apparatus to an existing rope at any point therealong by allowing the rope length to be fed in an axial direction over and into engagement with the pulley wheel.

Usually, the drive shaft will have a first end secured from displacement relative to the chassis and the displaceable cover will have a bearing mechanism for releasably engaging an opposed end of the drive shaft when the cover is connected to the chassis. In addition, it is preferable that each of the rope input guide member and rope output guide member are also mounted between and supported by both the chassis and the displaceable cover member when the cover is connected to such chassis.

Preferably, the attachment mechanism will comprise a rigid loop member, preferably a Karabiner type connector, projecting outwardly from the main body and secured from displacement relative thereto. This attachment mechanism will then usually comprise a releasable gate member for selectively opening or closing a channel through an outer wall of the loop member to allow a connector element of the load to be passed through the channel so as to engage and be supported by the loop member.

Furthermore, it is preferable that the displaceable cover of the apparatus will comprise an arm member which is received through the channel of the attachment mechanism when the cover is connected to the chassis so that when the gate of the attachment mechanism is closed, thereby closing said channel, this closed gate member serves to restrain the cover from displacement away from the chassis, often providing a secondary locking mechanism for holding the chassis and cover in the closed position when the apparatus is in use.

Preferably, the cover will be pivotally mounted on the chassis, usually by a hinge mechanism, so as to be pivotally displaceable from a closed position in engagement with the chassis to an open position.

It is also preferred that the attachment member is mounted towards an upper portion of the apparatus so that when attached to a climbers harness, usually in the region of the user's sternum, the major bulk of the apparatus will be disposed below the user's sternum so as to rest substantially in the users lap.

Preferably, the power driven rotational input means will have a first rotational axis and the drive shaft will have a second rotational axis extending parallel to, but remote from this first rotational axis, with a gear reduction mechanism then extending transversely between this first and second axis. In this manner, a more compact apparatus design is possible. Preferably, so as to extend transversely between such axis, the gear mechanism will comprise a conventional spur gear mechanism.

In addition, the apparatus will preferably be provided with a brake mechanism for selectively restraining rotation of the rotational input which, through the interaction of the gear mechanisms with the drive shaft, will also restrain rotation of the drive shaft and pulley wheel thus restraining the device from displacement along the rope when such brake mechanism is in engagement.

It is preferred that the brake mechanism will comprise an electro magnetic brake to restrain the rotation of the rotational input whereby the brake will be so as to restrain such rotation when power is removed from the electro magnetic brake and, preferably, also when the motor is switched off. This brake mechanism will subsequently be released to allow the input to rotate when power is connected to both the electromagnetic brake and the motor to switch both on.

It is preferable that the apparatus will utilize a battery pack as an electric power source for the motor and, where applicable, the electro magnetic brake, although it is envisaged that mains power could also be utilized with an appropriate umbilical cord connection to the apparatus.

Furthermore, the present invention may also or alternatively utilize a manual power source for rotating the rotational input means, usually in the form of a rotational manual handle which a user is able to rotate to directly drive and rotate the input means. Such a feature could be used in combination with an electric motor as a back-up should the motor fail, or may be used as an alternative to the motor to provide a manually powered climbing device.

The apparatus may further comprise at least one additional rope restraining mechanism biased into engagement with the rope so as to restrain displacement of the rope relative to the apparatus in a first direction whilst allowing relative displacement between the apparatus and the rope in a second opposite direction.

Such a restraint mechanism will usually be manually displaceable from a first position which is biased into engagement with the rope, to a second position out of engagement with the rope to allow displacement of the rope relative to the apparatus in either direction when the restraint mechanism is in the second position. Furthermore, it is preferred that the apparatus will comprise a manually displaceable switch member for operating the motor whereby such switch member will be operatively coupled with the restraint mechanism, such that manual displacement of the switch member from a first to a second position will effect corresponding displacement of the restraint mechanism from its first to its second position. Preferably such restraint mechanisms will comprise an ascender cam. In one preferred embodiment of the current invention the ascender cam will be provided with a cam bearer having a substantially concave surface for complimentary receipt of a convex surface of the cam member of the ascender cam. This concave surface may further be provided with gripping teeth, grooves or other surface irregularities for increasing frictional resistance and for restraining displacement of the rope in a first direction. Alternatively, the ascender cam may be provided with a substantially flat cam surface and the cam bearer may have a complimentary flat surface of complimentary design. By providing the cam bearer to have a complimentary shape to that of the cam member of the ascender cam compression of the rope is effected over a much greater area enhancing the extent of frictional engagement of the rope breaking effect of such ascender cam.

In addition, it is preferable that at least one of the rope input guide member and the rope output guide member will also comprise a rotatable pulley wheel which may be freely rotatable in a first direction, but which are restrained from rotational displacement in a second opposed direction. In this manner, these guide members may have free movement of the rope thereabouts in a first direction, but provide a frictional resistance to movement of the rope in the second direction. Here, for example, during ascent, the pulley wheels will be freely rotatable to allow the rope to pass thereover and thus not to provide any additional restraint during ascent, but during descent, frictional engagement between the rope and the non-rotating pulley wheels serve to restrict the relative displacement of the apparatus and assist in breaking during ascent.

Further according to the present invention, there is provided an ascender cam comprising a rotatably mounted cam member pivotally biased towards a cam bearer for compression of a rope passing therebetween, characterised in that said cam bearer has a rope engaging surface of complimentary shape to that of a rope engaging surface of said cam member. Preferably, where the cam member has a curved convex surface, the cam bearer has a complimentary concave surface. The surface of the cam bearer is preferably provided with rope engaging means such as teeth or indentations for increasing frictional engagement with the rope disposed between the cam bearer and the cam member, usually such that such engaging means engage with said rope only during relative displacement therebetween in a first direction.

BRIEF DESCRIPTION OF THE DRAWINGS

There will now be described, by way of example, a preferred embodiment of the present invention with reference to the accompanying illustrative drawings in which.

DETAILED DESCRIPTION OF THE INVENTION

Figure 1:
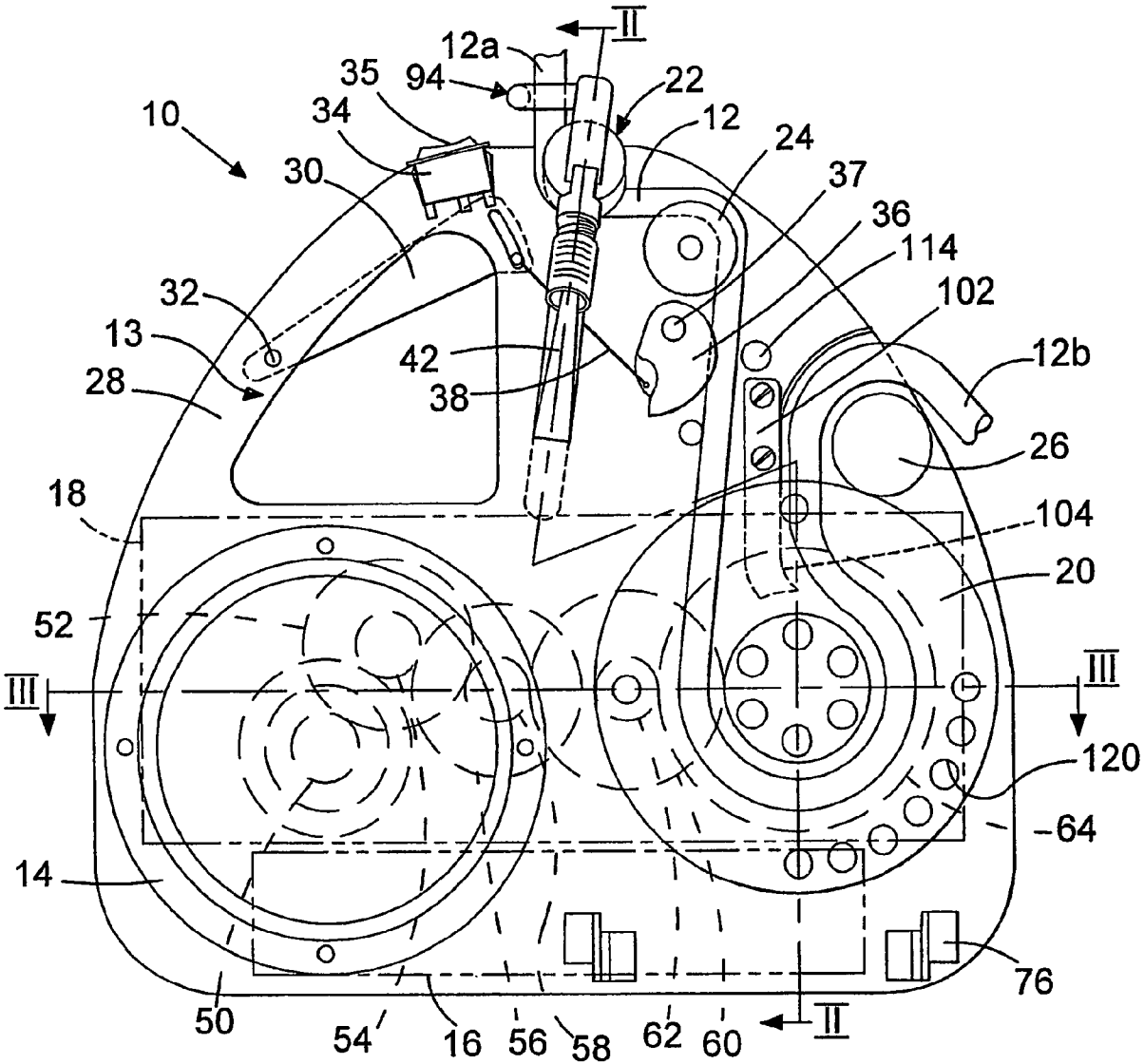
FIG. 1 is a schematic side elevation of a power climbing device according to the present invention having its front cover removed so as to show its internal workings.

Referring now to FIG. 1, a power operated rope climbing device 10 is generally illustrated. The view shown in FIG. 1 has a hinged front cover removed in order to show the internal workings of the device. The device 10 is intended for attachment to a rope or cable 12 so as to grip such rope and move the device therealong.

The device itself basically comprises a conventional DC electric motor 14, a portable power pack, (in this embodiment an electric battery 16 shown illustratively only in hashed lines), a gear reduction mechanism 18 (again shown in hashed lines illustratively in FIG. 1 and in more detail with reference to FIG. 3) and a main pulley wheel 20. The pulley wheel 20 is power driven by the motor 14 via the gear reduction mechanism 18 as will be described in more detail later. This pulley wheel (20) is preferably constructed of aluminium alloy, stainless steel or titanium.

A plurality of guide pulley wheels 22,24 and 26 serve to correctly loop the rope 12 through the device so as to correctly engage with the main pulley wheel 20.

The device 10 further comprises a substantially D-shaped handle 13 having a trigger switch 30 pivotally mounted thereon at a pivot point 32, which trigger switch 30 operatively engages an electronic switch member 34 which, when actuated, transmits power from the battery 16 to the motor 14 so as to operate the device.

The device further comprises a pivotally mounted eccentric ascender cam 36 resiliently biased, by means of a spring member (not shown), into engagement with the rope 12 in an unactuated position to assist restraint of displacement of the device 10 relative to the rope 12 when not in operation. This ascender cam 36 is operatively connected to the trigger switch 30 via an appropriate force transmitting member (in this example, a wire 38), whereby pivotal displacement of the trigger switch 30 will also effect pivotal displacement of the assembly cam 36 about its associated pivot axis 37.

The operation of the device will now be described in more detail with reference to FIGS. 1 through 3.

Figure 2:
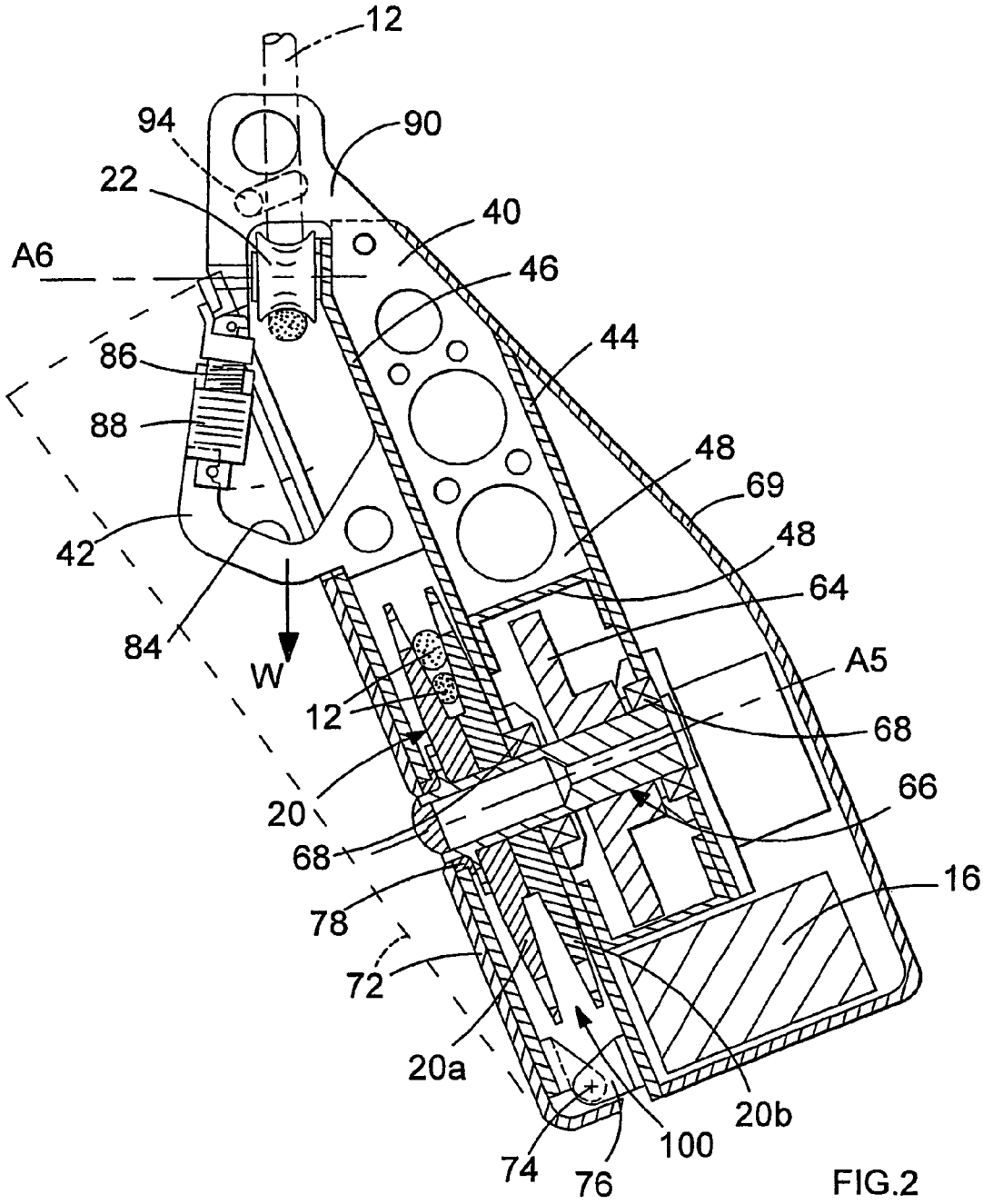
FIG. 2 is a staggered cross sectional view of a power climbing device of FIG. 1 along the lines 11-11.

FIG. 2 is a cross-sectional view of the device of FIG. 1 staggered along the line II-II so that the lower portion of FIG. 2 is a cross-sectional view through the main pulley wheel 20 whilst the upper portion represents a cross-sectional view through the main sub-frame 40 and harness attachment member 42.

The device 10 effectively comprises a main sub-frame or chassis 40 comprising two aluminium alloy sheets 44 and 46 with transverse aluminium alloy support struts 48 extending therebetween to add rigidity to the chassis thereby providing a strong yet lightweight support structure. Referring now to FIG. 3 it can be seen that the motor 14 is mounted on the front wall 46 of the chassis (by use of appropriate screws, not shown). Further referring to FIG. 3, the gear reduction mechanism 18 is now shown in greater detail and comprises a basic spur-gear reduction gearbox consisting of eight toothed gears wheels which effect an overall gear reduction ratio of 86.81:1. This provides for a gear reduction from the motor output speed of 2900 rpm to drive the main pulley 20 at a rotational speed of 34 rpm.

Figure 3:
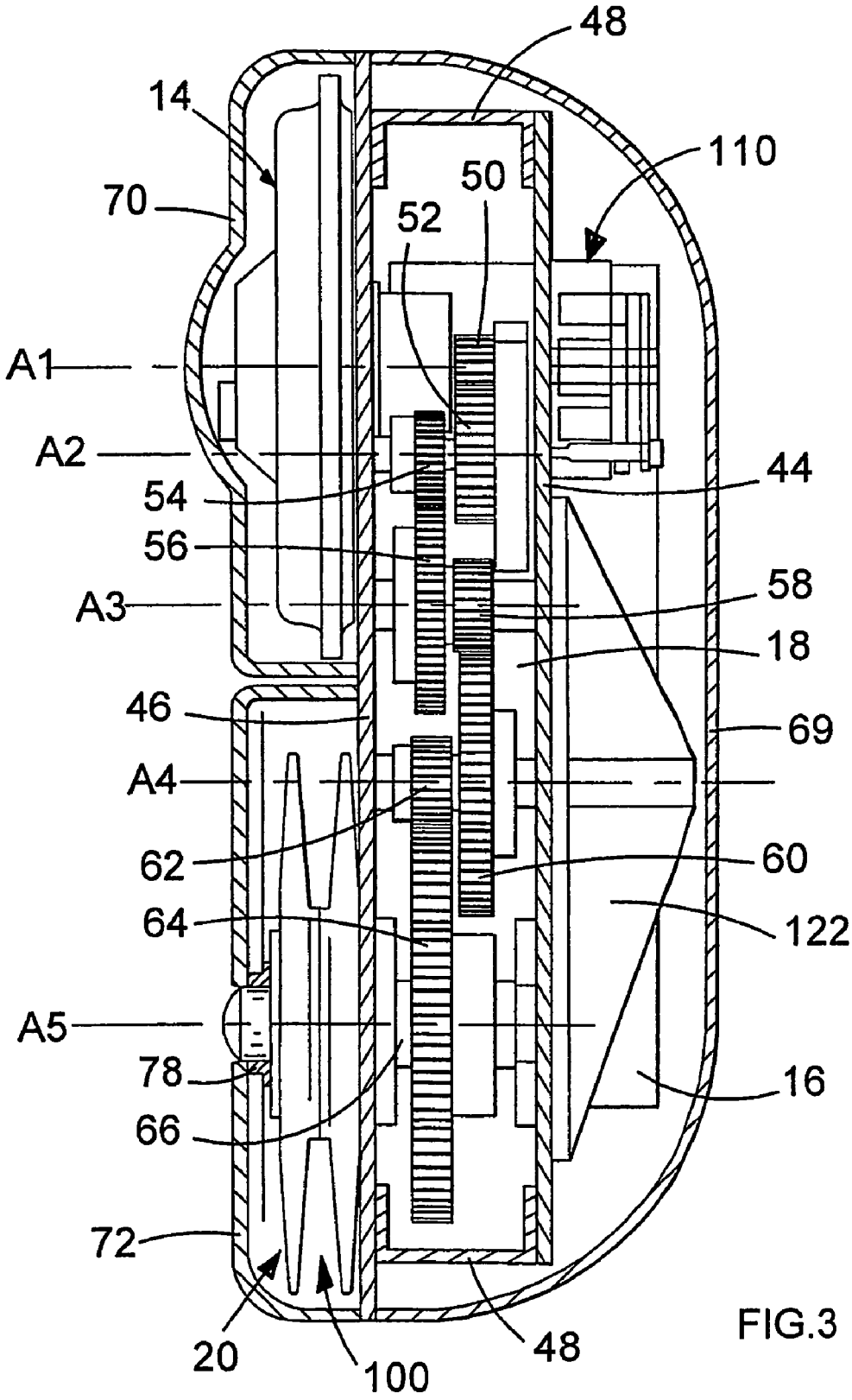
FIG. 3 is a cross sectional view of a power climbing device of FIG. 1 along the lines III-III.

Referring now to FIGS. 1 and 3 (wherein FIG. 1 the respective gear wheels are shown in dashed lines), the basic construction of the spur gear mechanism will now be described. The motor 14 has a first rotary output shaft having an axis A1, having mounted thereon a first toothed gear wheel 50 which engages with a second gear wheel 52 with a larger diameter mounted on a second parallel axis A2. Mounted coaxially therewith on axis A2 is a third gear wheel 54 which is in meshed engagement with a fourth gear wheel 56 mounted on a third parallel axis A3. Again, axis A3 has coaxially mounted a fifth gear wheel 58 in meshed engagement with sixth gear wheel 60 mounted on a fourth parallel axis A4. Axis A4 itself has coaxially mounted thereon a seventh gear wheel 62. This gear wheel 62 is then held in meshed engagement with the main gear wheel 64 mounted on a fifth parallel axis A5. This main gear wheel 64 is mounted on a main drive shaft 66 which has coaxially mounted thereon the main pulley wheel 20. This main drive shaft 66 consists of a stainless steel rod supported by a fully sealed stainless steel deep grooved bearing 68, with the main gear 64 mounted by conventional keyway on to this shaft. The main pulley 20 is mounted on this drive shaft 66 by use of appropriate bolts (not shown).

The sub-frame 40 is mounted within a protective case which may be manufactured of fibreglass or alternatively from a carbon fibre material or alternatively even moulded plastics. The case comprises three main components, a large back cover 69 securely mounted to the sub-frame 40, a first front casing 70, also referred to as a motor cover, which is again rigidly attached to the sub-frame 40 so as to encase the motor. The back cover and this first front cover 69 and 70 also serve to co-operate to form the D-shaped handle 13 therebetween.

Finally, there is also provided a second front casing member 72 which encases the main pulley wheel 20 and the rope path defined by the guide wheels 22,24 and 26. This second front casing 72 is pivotably mounted about a hinged axis 74, defined by conventional hinge member 76, which hinge member is mounted on the sub-frame 40.

This second front casing 72 is further provided with a phosphor bronze bearing mechanism 78 which, when the cover 72 is in a closed position as shown in FIG. 2, such bearing mechanism 78 supports a second end of the main drive shaft 66.

In this manner, it will be appreciated that the drive shaft 66 is supported at both of its opposed ends as seen in FIG. 2 when the front cover 72 is closed. For this reason, the hinge and front cover 72 will be made from an aluminium alloy and fibreglass since, due to its engagement and support of the drive shaft 66, the front cover 72 serves to hold support the load exerted on the main pulley wheel 20. The second main purpose of the use of pivotal front cover 72 is to allow side access to the pulley wheel and the associated guide wheels 22,24 and 26 to allow the rope 12 to be inserted and connected with the device 10 along any portion of its length, by simply feeding such rope into the apparatus in an axial direction so as to be placed about the pulley wheel 20 in the manner shown in FIG. 1 (sideways as viewed in FIG. 1). The cover 72, when closed, further serves to retain the rope in engagement with the pulley wheel 20 and the guide member 24,26.

Additionally, the guide members 24,26 as well as the ascender cam 36, whilst shown in FIG. 1 as mounted solely on the chassis, may also be additionally supported by appropriate bearings (such as phosphor bronze bearings) mounted on this front cover 72, in a manner similar to the support of the main pulley wheel 20.

It will be appreciated that whilst all such load bearing structures within the device 10 may be adequately supported on the chassis only, it is preferable to support them both on the front cover and the chassis when the front cover is in its closed configuration.

A conventional latch mechanism (not shown) is mounted on the sub-frame towards its upper region for engaging and retaining this pivotal front cover 72 in its closed position.

In addition, and again not shown, the rear cover 60 may also comprise a removable hatch cover to allow the battery 16 to be replaced when appropriate.

The climbing device 10 further comprises an appropriate harness (or load) attachment member 42, again rigidly mounted directly to the sub-frame 40 (see FIG. 2). This attachment member 42 will conventionally comprise a karabiner type arrangement extending from the device 10 substantially at right angles thereto so as to provide for direct attachment, allowing a users harness loop to be connected directly to the climbing device 10 avoiding the need for an additional separate karabiner loop attachment to be connected between the user's harness and such apparatus. The majority of climbing harnesses, whether recreational or professional, have "ring" attachment points which can thus be clipped directly to the harness attachment and which, under the weight of a user of such harness, the D-shaped ring will nestle in the lower groove 84 of the attachment member. As for standard karabiner type attachment members, a conventional spring gate 86 is provided which is biased towards the closed position shown in FIG. 2 by a spring (not shown) and which gate has a rotatable screw threaded sleeve 88 which can be rotatably displaced along the length of the gate 86 so as to cooperate and engage with a main stem of the attachment member 42 to lock the gate in a closed position. Similarly, the sleeve 88 can then be selectively unscrewed to allow manual displacement of the gate 86 to an open position, effectively opening a channel through an outer wall of this loop 42 to allow a harness ring to be attached to a member 42 in a conventional manner.

It will be appreciated that this attachment member 42 (made of aluminium alloy) may be considered to comprise two halves. The top half 90 forming a pulley support member for supporting the guide wheel (or pulley) 22 which is mounted about an axis A6. The bottom half of the attachment member 42 acts as an attachment hook for providing a groove or seat 84 in which a D-shaped harness ring will actually sit. The guide wheel or pulley 22 is further provided with a stainless steel axle member along axis A6, rigidly engaged between the chassis walls 40 and the attachment member 42 to provide rigid support for the pulley.

Axis A6, as is seen in FIG. 2, is inclined relative to the drive shaft axis A5 (and hence the parallel axis of the motor and gear mechanism). This results in the pulley wheel 22 being inclined relative to the main pulley wheel 20. However, it is important to note that the axis of the pulley wheels 24 and 26 are parallel with the axis A5 and these wheels are thus mounted parallel and in the same plane as the pulley wheel 20. As will be described later, the inclination of this pulley wheel 22 on axis A6 serves to aid in displacing the bulk of the device 10 away from the users body when a load W is attached to the attachment member 42.

Further mounted on the upper portion 90 of the harness attachment member 42 is a rope stay or guide member 94 having a restricted aperture through which the rope may be squeezed and held in an initial position. This rope stay 94 serves as an initial guide means for a rope 12 entering the climbing device 10.

In use, a user will affix the climbing device 10 to a rope (this device particularly designed for use with low stretch kemmantle ropes of 10.5 to 11 mm in diameter) by firstly releasing the latch on the pivotal cover member 72 and pivotally displacing the cover 72 to an open position so as to expose the internally mounted pulley wheel 20 and associated guide wheels 22,24 and 26 as shown schematically in FIG. 1. To open this cover 72, it is also necessary for the spring gate 86 to be opened to allow an arm member of cover 72 (not shown) to be pivotally displaced past such spring gate during opening and closing of the cover.

This provides an additional safety feature for the device whereby the cover 72 can only be opened when the spring gate 86 itself releasably opened. Since it is important that the gate remains closed (and is spring loaded to this effect) when a harness is attached to the attachment member 42, the cover cannot be accidentally opened when the device is under load.

Once the cover 72 has been opened, the rope 12 can then be fed into the main support mechanism as follows. The rope is firstly inserted into the rope stay 94 by simply passing through an opening therein (not shown). Furthermore, the rope is then passed into the harness attachment member 42, through the open spring gate 86 so as to engage with the first guide wheel or pulley 22 which substantially turns the rope through 90 as it enters the climbing device 10. This guide wheel will be manufactured of an aluminium alloy mounted in a phosphor bronze bearing. The guide wheel 22 may also be provided with a roller clutch which would enable a pulley to turn freely in one direction (i.e. when the device ascends the rope, but not to turn when descending the rope, and therefore creating a friction bearing during descent to assist breaking of the device.

The rope is then passed about a second aluminium alloy pulley or guide wheel 24 which again turns the rope through a further, substantially, right-angled turn before being passed over and around the circumference of the main pulley 20. As before, the second guide wheel may again be mounted in a conventional phospherbronze bearing or, alternatively, could be mounted on a roller clutch as for pulley 22 so as to enable rotation in a single direction and to assist breaking in a second direction. Furthermore, this second guide wheel 24 also serves to twist the rope slightly so as to align it with the main pulley wheel 20. As previously described, the first pulley wheel 22 is mounted about an axis A6 which is inclined relative to the axis A5 about which the main pulley 20 is mounted. Subsequently, the two additional guide wheels 24 and 26 are mounted with parallel axis and lie within the same plane as the main pulley 20. Therefore, although not shown in FIG. 2 it can be seen how the rope 12 is twisted so as to align with the main pulley 20 and this is achieved about guide wheel 24.

Whilst it is preferred that the guide wheels or pulleys 22,24 and 26 be formed as V-shaped pulley wheels, usually of aluminium alloy, it will be appreciated that their specific design is not essential to the operation of the current invention and alternative variants to such V-shaped bearing wheels could be equally employed such as deep groove ball bearing races or, simply, rotatable or fixed metallic rods which allow the rope to flow over in a defined path. However, the use of V-shaped grooves, specifically roller clutches, are preferred in the current embodiment. Additionally, since the output rope 12*b* passing around the wheel 26 is not required to be under any load then wheel 26 could be replaced by a non rotatable pin member or other form of bearing in order to simplify the design.

Member 26 is simply to act as a means for defining the path of the rope about the pulley wheel 20.

Rope 12 is then aligned past the ascender cam 36 (for convenience, the ascender cam used herein is a Wild Country Ropeman Ascender Mark II Stainless Steel cam). The construction and operation of this cam will be described later. The rope 12 is then fed around the main pulley 20 as again seen in FIG. 1, so as to be looped thereabouts before finally being passed over the final guide wheel 26, which may be a similar pulley wheel to that of guide wheel 24 or may simply be a fixed friction bearing about which the rope 12 can pass. In particular, the placement of this third guide wheel 26 serves to maintain the rope 12 in engagement with the main pulley wheel 20 about the majority of its circumference.

Specifically now referring to FIGS. 2 and 3, it can be seen that the main pulley wheel 20, (usually made from a light weight aluminium alloy), is provided with a deep tapered V-shaped groove 100 for receiving the rope 12. In particular, the tapered inner faces of the groove 100 are inclined relative a plane perpendicular to the axis A5 at an angle of between 3.5 and 17.5 having an optimum angle of 5, thereby defining a V-shaped taper defining an optimum angle therebetween of 10 (5+59. However, the combined angles of such groove can lie between 5' and 35. The use of this very deep tapered groove is two-fold. Firstly, when load is applied to the rope 12 as it extends about the circumference of the pulley 20, the rope will be pulled deeper into this tapered groove 100. The deeper the rope is pulled into the groove the higher frictional forces will be exerted therebetween providing greater grip between the pulley 20 and the rope 12. Secondly, the deeper the rope 12 is pulled into the groove 100 then the operational diameter of this pulley 20 is reduced thus reducing the torque required to lift the load of the device 10 and any user suspended therefrom, which provides for better power efficiency of the device. This is particularly beneficial in a portable device of the present invention whereby power is often supplied by use of battery packs and improved power consumption is a major manufacturing consideration.

In addition, as will be appreciated from FIG. 2, the pulley wheel 20 is capable of accommodating different diameter rope sizes. This preferred embodiment is intended for use with kernmantle ropes of between 10 and 13 mm diameter whereby the narrower ropes are able to be pulled closer to the pulley axis A5 than thicker ropes (see FIG. 2). However, in both instances, the tapered nature of the V-shaped groove is sufficient to provide a sufficient frictional engagement with a rope at its optimum distance from the axis A5. However, a further embodiment of the current invention further provides the use of cylindrical spacer elements (or packers) which can be placed between two distinct (and separable) hubs 20A and 20B of the pulley wheel 20. The cylindrical spacer elements will resemble conventional washers and simply serve to increase the width of the V-shaped groove 100 whilst maintaining the same angled taper. In this way, ropes thicker than 13 mm diameter can be accommodated within the same apparatus using basic component parts. Alternatively, ropes between 10 and 13 mm are able to be drawn closer to the axis under appropriate load. Both of which features are advantageous in either accommodating a much greater range of rope sizes or alternatively lowering the power consumption of the device by reducing the torque. In particular, the ability to add such spacer or packer element to the device is a low maintenance job which could be carried out in situ, thus increasing the applicability and flexibility of the current device to different situations allowing its use in the field to be readily adapted to different rope sizes.

A further important design feature is the control of the input path and output path of the rope 12 from the pulley wheel 20, which paths are maintained as close as possible to one another by use of the two guide wheels 24 and 26 so that the rope 12 is engaged with the pulley 20 about the majority of the axis A5, causing the pulley 20 to grip the rope along a great a length as possible as it passes around this pulley, so as to increase the frictional force therebetween. Since it is preferable for the rope to be drawn as deeply into the V-shaped groove as possible to increase the frictional engagement therewith, then the smaller effective diameter of the pulley about which the rope extends, reduces the overall length of engagement of the rope with the pulley. For this reason, it is preferable to maintain the rope in engagement with as much of the pulley wheel diameter as possible. In this embodiment, the rope 12 engages about approximately 85% of the pulley diameter. It is preferred that the rope 12 be maintained in engagement with the groove for at least 50% of the groove circumference. It will be appreciated that for larger diameter wheels then the necessity for maintaining the rope in engagement with the pulley about the majority of its circumference is reduced since an equal length of rope will be engaged in such a groove having a larger effective diameter. However, since this apparatus is intended to be portable and use a battery as a power source, then its weight and size are major manufacturing constraints and thus, in order to maintain the pulley wheel as small as practicably possible, then in order to maintain grip with an appropriate length of rope, that rope must be maintained in maximum engagement with the pulley wheel about its circumference.

The pulley 20 is further provided with a rope extractor 102, usually made of light-weight aluminium or a light weight plastics material such as nylon. The extractor 102 is effectively a elongate member projecting into the groove 100 of pulley 20 having a curved cam surface 104 for engaging and extracting the now "wedged" rope 12 out of this groove 100 and also serves as a guide means for directing the rope 12 about the guide wheel 26.

Thus, in operation, the rope is inserted through the front of the now open climbing device 10 so as to extend around the array of pulley wheels as shown in FIG. 1.

This provides for a significant advantage over existing winches and pulleys of the type which utilise a power driven clamping means to move a rope therethough.

Conventional systems only allow the rope or wire to be fed end first through such clamping or gripping means and do not provide the benefit of allowing the rope to be inserted through a side panel as in the current invention. The major advantage of allowing the rope to be inserted through a side panel as now described, is that the device can be attached at any position on a rope and not only at one of its opposed ends. This is a significant and major advantage when used for rope climbing since it is quite often necessary for the climber to join and leave the rope at different positions, not necessarily at the top and bottom thereof. This is particularly true for maintenance work and rescue work. Secondly, rope climbers will often require to ascend and descend a plurality of ropes and thus necessitate the portability of this type of device to be readily moved and attached/detached from one rope to another.

In practice, once the rope has been positioned about the pulley 20 as shown in FIG. 1, then the weight of the device itself will result in the rope 12 being pulled into groove 100 of pulley 20. When a user then attaches themselves to the harness attachment member 42 in the manner previously described, the effective weight of the rope climbing device is increased by weight of the user suspended therefrom and this additional weight then causes the rope 12 to be pulled even deeper into the V-shape groove 100 increasing the frictional engagement therewith and thus automatically supporting the additional weight added to the rope climbing device 10. Thus, the device automatically adjusts the necessary grip on the rope when increased weight is added by increasing the friction exerted on the rope as it is drawn deeper into the V-shaped groove.

A further advantage of the device of this type is that portion of the rope 12*b* which exits the device about pulley wheel 26 need not be tensioned in order for operation of the device or to provide sufficient frictional engagement between the rope and the pulley wheel 20. All conventional climbing apparatus requires tension to be exerted to the rope either side of conventional climbing devices in order for them to operate effectively. However, the arrangement of the rope around the pulley wheel 20 in the manner previously described, and particularly by use of the guide member 24 and 26, alleviates this requirements and thus provides a greater degree of flexibility of use of this type of climbing device by obviating the need to apply a load to the rope extending below the climber.

As will be appreciated, the motor 14 is provided with an electronic brake 110 which, in this particular embodiment, comprises an electro-magnetic brake which is fitted to a remote end of the motor output shaft and which is activated so as to lock the motor shaft when power is removed from this brake. This type of electro-magnetic braking is well known in the art and will not be described further herein, save to explain that when power is provided to the motor 14, it is simultaneously applied to the electro-magnetic brake 110 which is thus deactivated allowing the motor shaft to rotate freely under the influence of the motor. In the event that power is subsequently removed, the brake is thus activated which then locks the motor output shaft and hence the gear wheel 50 mounted thereon. Engagement with the gear wheels of the gear mechanism 18 thus locking such gear wheels from rotational displacement about their respective axis and, since the meshed gear wheel 64 is further restrained from displacement and it is rigidly secured to the main drive shaft 66, this drive shaft 66 is also restrained from rotational displacement by the brake thus preventing rotation of the pulley wheel 20 when the brake is operated. In this manner, when the device 10 is mounted about a rope as previously described, then the gear box 18 and motor 14 serve to take the load of the device 10 and the user mounted thereon, when the brake is operated (by removing power therefrom).

It will be appreciated that in this manner the braking mechanism preferably employed further acts a failsafe similar to the principle of a "deadman" brake, whereby should the user somehow become incapacitated when attached to a rope 12 by such a device, and releases the trigger switch 30 then the motor will be de-activated and the brake will also be automatically engaged, on release of the power switch or trigger switch 30, to prevent an uncontrolled descent.

Specifically, the trigger switch is pivotal into and out of engagement with the electronic switch member 34 such that when it is engaged with the electronic switch 34, the trigger is able to effect power transfer to the motor and also to the electromagnetic brake 110 substantially simultaneously, such that the motor, through its engagement with the pulley 20, takes up the strain of the rope as the brake is thus removed. Rotation of the motor then allows the device to ascend or descend the rope accordingly. By releasing the trigger switch the power is also simultaneously removed from the motor and the brake 110, which electromagnetic brake then automatically restrains displacement of the motor drive shaft to effect braking.

Alternatively, a positive brake mechanism could equally be employed which could be driven by a separate electric motor to engage and clamp the rope 12 when power is transmitted to such a brake mechanism (not shown) whereby power will be transmitted to the brake mechanism simultaneously with power being removed from the motor mechanism. This could employ a very simple switching mechanism whereby pivotal displacement of the trigger switch 30 would deactivate the brake while activating the motor and vice versa. However, it will be appreciated that many different forms of braking mechanisms can be employed which may be electrically controlled and dependent on the position of the trigger switch. However, in all cases, what is important is that in the event that the trigger switch 30 is released such braking mechanism will restrain displacement of the device relative to the rope 12.

Additional braking means are also employed as a back up to help arrest a fall should the brake or gear box fail in any manner. This primarily takes the form of an ascender cam 36 of a type commonly available for manual climbing operations and which acts in substantially the same manner. This ascender cam 36 is provided with a plurality of downwardly facing teeth (not shown) mounted on an eccentric curved surface of the cam which is resiliently biased by a spring (not shown) into engagement with the rope 12 of FIG. 1. The ascender cam operates on the principle that the rope when moving downwardly as viewed in FIG. 1 the rope simply slides over the downwardly facing teeth, which does not therefore restrict such passage of the rope during ascent of the device 10. However, during descent, when the rope moves upwards relative to the device 10 and hence ascender cam 36, the rope will snag or engage the teeth to exert a counter clockwise force on the cam 36 (about its axis 37) which serves to arrest further displacement of the rope. If sufficient force is applied, the eccentric surface of the ascender cam 36 can eventually compress the rope 12 against a secondary pillar member 114 to completely clamp the rope from further displacement in a conventional manner.

Thus, to operate the rope climbing device 10 as previously described, the user will first feed the rope around the lifting mechanism as previously described and subsequently close the second front casing 72 and lock it to the back cover 68 by use of an appropriate latch mechanism. When this cover 72 is closed, it further serves to prevent the rope 12 slipping or moving out of engagement with any of the guide or pulley wheels. As a second fail safe to ensure that the cover 72 does not inadvertently open during use which could cause the rope 12 to slip from one or more of its guide wheels, part of the cover 72 must pass through the open spring gate 86 and when the spring gate 86 is subsequently closed, it further serves to prevent the cover 72 from becoming opened. Since no power is presented to the motor 14, the electromagnetic brake 110 prevents rotation of the pulley 20 and the rope 12 is subsequently drawn into the groove 100 to frictionally engage therewith. In this manner, the input portion of the rope 12*a*, which is considered to be that portion of the rope connected to an anchor point for the rope, then is held under load due to the weight of the device itself. The rope 12*b* exiting the climbing device 10, is free of any load resulting from the weight of the device itself.

A user is then able to attach themselves to the harness attachment member 42 by use of a conventional "D" ring attachment point on a climbing harness thereby exerting a downward load, equal to the mass of the user, in a direction W as shown in FIG. 2. As is conventional for this type of Karabiner harness attachment, the D-ring is inserted into the attachment member which is then locked by an appropriate rotation of the screw threaded member 38. Since the mass of the user is considered to be greater than that of the device 10 and such mass is exerted perpendicular to the axis A6 of the first guide wheel 22, the device 10 is caused to pivot substantially about the guide wheel 22 to the position shown in FIG. 2 so that the major weight vector W is in line with the vertical rope 12 extending from an anchor point (not shown). Since the rope 12 passes around the axis A6 in the manner shown substantially in FIG. 2, then the pulley wheel 22 acts, in this manner, as a pivot point for the device 10 mounted on the rope 12.

When the apparatus is unloaded then the weight of the device itself presents a moment about this pivot axis on pulley 22 causing the apparatus to substantially hang down therefrom such that the attachment member 42 will project tangentially outwards. With reference to FIG. 2, when the apparatus is unloaded, then the front wall of the apparatus 72 will lie in a substantially vertical plane. However, when a load is connected to the harness 42 such that its mass acts in a direction W as shown in FIG. 2, this creates an additional moment about the axis defined by the pulley 22 which will be substantially greater than the relatively lightweight climbing apparatus 10, resulting in pivotal displacement of the mass of the apparatus 10 away from the users body (from left to right as viewed in FIG. 2) such the main load W acts substantially in line with the loaded rope 12A. This provides a further advantage of the current invention whereby the vast bulk of the device 10 is thus pivoted away from the users body for additional comfort.

Additionally, since most climbing harnesses utilise a D-ring attachment point at chest level and substantially in the region of the sternum, then the current position of the harness attachment 42 towards the upper portion of the body provides for the device 10, when attached to the D-ring of the users harness, to sit in the operators lap rather than be held at chest level height which could inconvenience the user. However, it will be appreciated that different physical designs of the device are equally applicable having the harness attachment member 42 fixed in different positions.

Once the user has connected the device 10 to the rope 12 and has connected himself to the harness attachment 42, he is then able to grasp the handle 28 and depress the trigger switch 30 to as to activate an appropriate electronic switch 34 to provide power to the motor 14 in a conventional manner. In this embodiment, this electronic switch 34 is a bi-directional switch member having a conventional rocker switch element 35 which may be operated by the users thumb so as to be pivotally displaced in a first or second direction to control the direction of the motor. This again serves a dual purpose of firstly providing a dual switching mechanism (i.e. the rocker switch member 35 has to be moved to one of the first or second positions and the trigger switch 30 has to be activated simultaneously in order to provide power to the motor 14). Secondly, this particular switch allows the climbing device to be used as an ascender or descender. In order for operator to ascend the rope 12, he must pivot the switching element 35 forwards so that on operation of the trigger switch 30 the motor is driven in a first direction so as to cause rotation of the pulley 20 in a anti-clockwise direction thus drawing the rope 12A downwardly into the groove 100 as a result of frictional force therebetween and subsequently causing the device 10 to climb up the rope. Where, as previously described, the guide wheels 22,24 and 26 comprise roller clutches, these pulley wheels will rotate freely during such ascent. In addition, it will be appreciated that the pivotal displacement of the trigger switch 30 will also affect rotational displacement of the ascender cam 36 out of engagement with the rope 12 as the wire 38 serves to physically displace this ascender cam in a clockwise direction about its axis 37.

When the user wishes to stop their ascent they simply release either or both of the switching elements 30,35 whereby the electro magnetic brake 110 will then prevent continued displacement of the pulley 20 and hold the climbing device 20 in its required position.

For the user subsequently to descend using the device 10, then the rocker switch element 35 must be disposed in an opposite direction and again the trigger switch 30 activated, this time reversing the rotational output of the motor 40 to rotate the pulley 20 in a clockwise direction thereby moving the rope 12 upwards with respect to the device 10 to allow a controlled descent. Again the ascender cam 36 is moved out of engagement to rope 12 to allow the rope to pass over, but here is noted that the guide wheels 22,24, where employing a roller clutch, are restrained from rotation in this clockwise direction whereby the rope must subsequently slide over such guide wheels and incur a frictional resistance which provide an additional safety feature to help arrest descent of the device should there be slippage of the rope by the pulley wheel 20 or should the electro-magnetic brake fail for any reason. As previously described should the electromagnetic brake fail, then the ascender cam, on release of the trigger switch 30 will also serve to arrest unwanted descent of the device.

Further to enhance safety of this device, the switching mechanism relies on the trigger switch 30 to be displaceable so as activate a main power switch 34, which itself comprises a rocker switch element 35 as previously described. This rocker switch 35 will be resilient biased to a neutral position whereby the switch mechanism 34 cannot then be activated in this neutral position by operation of the trigger switch 30. Hence both the switch member 34 must employ displacement of a rocker switch member 35 coupled with pivotal displacement of trigger switch 30 so as to activate the motor 14 and deactivate the electromagnetic brake 110.

This provides a dual switching mechanism whereby should the operator lose control of the device by either releasing the trigger switch 30 or by releasing the rocker switch 35 both will prevent continued power being provided to the motor and electro-magnetic brake 110, effectively braking the device.

A rocker switch 35 is preferably used in the current embodiment since it allows, through conventional design, inclusion of a waterproof plastic moulding to protect the electronic circuitry of the switch when used in outdoor conditions. However, as an alternative, a simple sliding switch element could equally be employed, especially where such a sliding switch is biased to a neutral position.

Furthermore, whilst the dual switching function described above is preferable, it is to be considered as optional. For example, when used to ascend a rope, there is no need to displace the ascender cam 36 out of engagement with the rope since the rope is able to flow freely over the ascender cam as the device climbs the rope. In this situation, a single switching requirement could be utilised for ascent whereby only operation of the rocker switch 35 need be employed to provide power to the motor. However, when descending, then the ascender cam 36 will need to be displaced (again as previously described) by manual operation of the trigger switch 30 and thus would require dual switching in order to ensure the operator activates the trigger to not only remove the ascender cam but also to provide power during descent to the motor. The switching mechanism can be readily adapted so as to provide such a dual switching function during descent and a single switching function during ascent.

It will be appreciated that there are many modifications to this preferred embodiment which still fall within the scope of the current invention. In particular, the specific gear ratio described above can be varied dependent on the motor output speed and the required ascent/descent speed of the device.

Alternative gear mechanisms could also be employed, such as epicyclic gearbox reduction mechanisms or worm gear mechanisms, although it is important to note that the use of the spur gear arrangement described herein provides for an efficient compact design which is important for such a portable device. In particular, the use of a spur gear mechanism allows the motor and main pulley 20 to lie substantially coplanar with one another. By having the motor and the main pulley 20 coplanar in this manner avoids the necessity of a bulky and wide design which could effect the centre of gravity of the user significantly.

It will also be appreciated that the operational speed and power consumption of the device is very much dependent on the torque exerted by the pulley on the rope.

It is preferred to have a controlled slower speed with reduced torque by allowing the rope to extend around the pulley axis 35 as close thereto as possible.

However, the closer the rope, the slower the rate of ascent/descent. Since power consumption control is usually more desirable to speed, the use of the spacer elements as previously described can be used to allow the rope to be drawn more closely to this axis and thus increase efficiency.

Another important feature of the present invention is that the device should be as light-weight as possible to again reduce power consumption and improve its portability when being carried.

To further reduce the weight of the apparatus, the main pulley wheel 20 is shown herein provided with a plurality of holes 120 which primarily serve to reduce the overall weight of such pulley wheel. However, such a series of holes employed in the pulley wheel may further serve to enhance the frictional engagement between that wheel and a rope therein, whereby the rope compressed between the two side walls of the V-shaped groove will be under a significant compressive force and will thus partially flow into any recess formed within the side walls of the V-shaped groove, thus any holes formed therein to help reduce over-weight will also serve to increase engagement between the pulley 20 and the rope.

Alternatively, the pulley 20 can be further enhanced by providing a series of radially extending ridges and grooves on the inwardly facing side walls of the groove 100 which again will facilitate increased grip in the pulley and the rope as it is compressed under load. Preferably these radially extending ridges and grooves will be substantially rounded to prevent any possible cutting and to reduce wear on the rope as its compressed therebetween. This idea can be taken further whereby instead of the uniform circular plates forming the pulley wheel 120, the mass of such wheel could be significantly reduced by providing the wheel with a plurality of radially extending arms, similar to a ferris wheel, which again such arms form tapered V-shaped grooves therebetween. This way, as the rope 12 extends around the groove in such a series of arms, it will again undergo frictional compression as its drawn, under load into its tapered groove whereby the compression of the rope between the arms will result in flow of some of the rope material into the space between the arms which further enhances the frictional grip on the rope in operation. As such, it is to be appreciated that reference to a pulley wheel in the current invention is intended to include such a ferris wheel type arrangement. The key feature here being the appropriate tapered nature of the groove of such wheel.

As an alternative engagement means to the main pulley wheel 20 to grip the rope, the V-shaped groove 100 could be replaced by substantially rectangular groove having a plurality of appropriate teeth either on the inner radial surface of the drum or on the opposed side walls of this rectangular shaped groove, which teeth would engage the rope as against the pulley wheel 20 to effect a mechanical grip thereon. Whilst the use of teeth to grip the outer sheathing of the rope 12 would do so with a minimum of damage, difficulties would be incurred when the rope 12 subsequently leaves the pulley 20, quite often such teeth are effectively "ripped" out of engagement with the rope which can cause tearing of the outer sheath fibres and eventually lead to a weakening or failure of the rope. However, it is possible that a mechanical means could be provided in the outer region of such pulley wheel, where a rope enters and leaves from this toothed engagement, whereby at such areas the teeth could be caused to retract (i.e. move axially out of the rectangular groove), in a controlled manner so as not to cut or damage the sheath of the rope. An example of such a mechanism could employ an outer cylindrical plate mounted on the outer surfaces of the pulley wheel 20 so as to have teeth projecting therethrough under a biasing force, which biasing force is removed, possibly by use of a cam member, so as to force the teeth outwardly of the pulley wheel 20 in the specific input/output regions thereof in a controlled manner and direction so as to avoid damage to the rope. The use of teeth in this manner would obviate the need for frictional engagement effective by the V-shaped groove with a preferred embodiment allowing for a pulley wheel 20 of far smaller diameter, thereby reducing its size and associated weight, whereby a smaller operational diameter reduces the effective torque necessary to achieve appropriate lift and thereby improve power consumption.

A further variation to the present invention is to employ the use of an appropriate electronic controller card or circuitry 122 to employ the motor 14 as a generator for recharging the battery 16 during descent. Whilst the aforementioned description provides for the motor controlling both ascent and descent, the device provides for powerless descent whereby instead of utilising the motor to provide controlled clockwise rotation of the output pulley 20, descent could be achieved by simply deactivating the electro-magnetic brake 110 and utilizing mechanical braking means, such as an ascender cam, to control the rate of flow of the rope 12 through the device 10. In this case, as the rope 10 passes about the pulley 20 it is rotated in a clockwise direction and this clockwise rotation of the pulley 20 subsequently drives the gear mechanism 18 in reverse effecting rotation of the motor 14 which is then employed as a generator for recharging the battery 16 by use of an appropriate electronic control circuit (here shown as 122 in FIG. 3) thereby recharging the battery during descent, to allow for subsequent powered ascent when necessary. As is well understood, no effort is required on behalf of the user during descent and thus, the users mass could be employed to recharge the battery to increase its effective performance. An appropriate controller card for this particular application is Model No NCC-70 distributed by the company 4QD. This operation is really understood by those skilled in the art and need not be described further herein.

Figure 4:
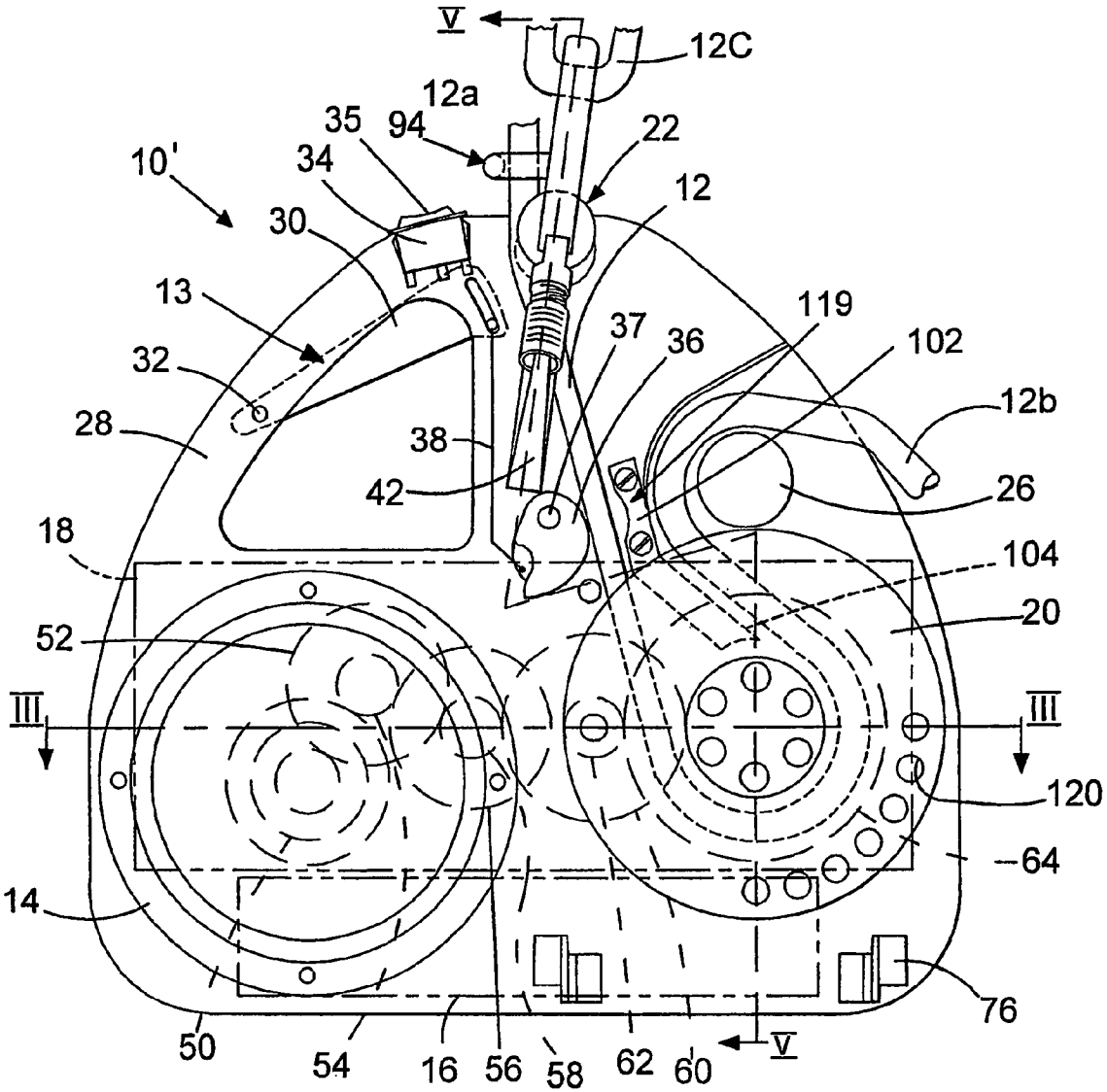
FIG. 4 is a schematic side elevation of an alternative embodiment of a power climbing device according to the present invention having its front cover removed so as to show its internal workings.
Figure 5:
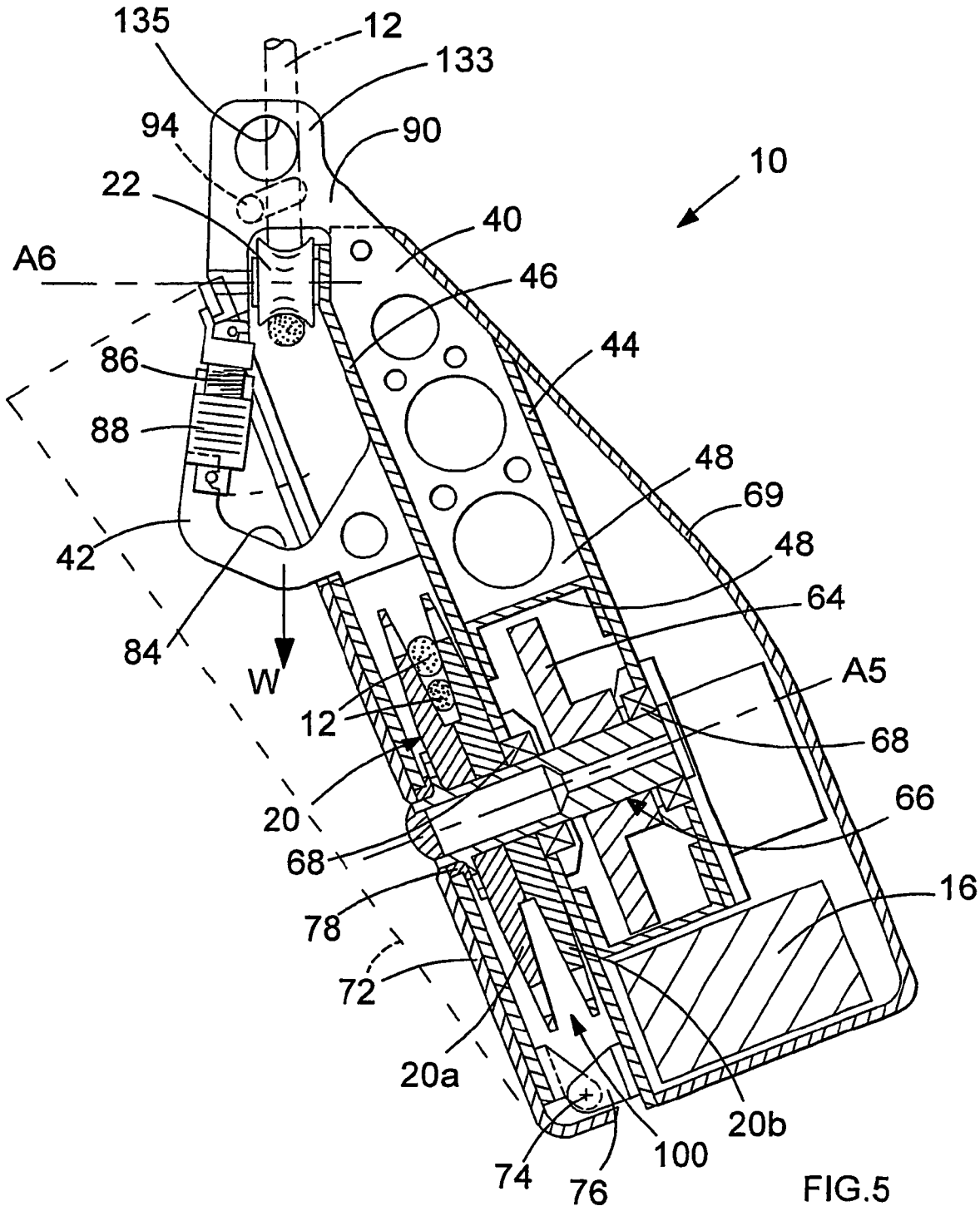
FIG. 5 is a staggered cross sectional view of a power climbing device of FIG. 4 along the lines V-V.

Referring now to FIG. 4 and FIG. 5, an alternative embodiment of a climbing device 10 is now shown. The climbing device 10 corresponds substantially to that shown in FIGS. 1-3 but specifically includes a modified load attachment member 42 and a modified rope path within the apparatus itself. The embodiment of FIG. 4 further employs the use of modified ascender cam 36, 119 as will now be described. However, the majority of the device 10 corresponds to the equivalent device 10 that shown in FIGS. 1-3 and like numbers are used to identify identical features of the two climbing devices 10.

Referring now to FIG. 4, the pulley 24 of the embodiment shown in FIG. 1 has now been omitted so that he rope 12 extends directly between the guide wheel 22 mounted on the karimber 42 and the main pulley wheel 20. Since the entry path of rope 12 into the pulley wheel 20 has now been modified, the position of the output pulley wheel 26 has been adjusted so as to ensure that the rope 12, as it exits the main pulley 20, is as close to the rope 12 as it enters this pulley wheel 20 as clearly shown in FIG. 4 and the importance of which was described with reference to the first embodiment. This has also necessitated modification of the design and orientation of the rope extractor 102 and its associated cam surface 104. The modification in the path of the rope 12 within the device 10 has also necessitated a change in position of the ascender cam 36, although this cam 36 is again directly connected to the trigger switch 30 by use of an appropriate wire mechanism. However, in this embodiment, the ascender cam is provided with a modified cam bearer 119 which has a substantially concave cam bearer surface.

The rope 12 passes between the cam member 36 and this cam bearer surface 119 such that the cam 36 is resiliently biased towards the cam bearer surface 119 so as to compress the rope therebetween (shown displaced against such biasing in FIG. 4 for clarity). As for conventional ascender cams, the cam member 36 will have a plurality of teeth extending in a first direction which will allow free movement of the rope over those teeth in a first direction but the rope will engage the teeth when disposed in an opposite direction there across. Therefore, as the rope engages with these teeth it will effect (when viewed in FIG. 4) anti-clockwise rotation of the cam member 36 about is pivot axis 37 so as to increase displacement of the cam member towards the cam bearer 119. Since the cam bearer is now provided with a novel concave surface of complimentary shape and design to that of the surface of the cam member 36, the rope extending therebetween is compressed into engagement with the cam bearer over a much greater surface than would occur with conventional cylindrical pin normally associated with ascender cams of this type. This greater surface contact with the rope thus increases the frictional engagement therewith and increases the efficiency of the ascender cam. This efficiency is further increased by the inclusion of a plurality of teeth or indentations on the concave surface of the cam bearer to further enhance its frictional engagement with the rope extending thereover, usually inclined relative to the rope so as to only engage the rope during relative displacement in a first direction only.

As with operation of the ascender cam in the embodiment shown in FIG. 1, when the trigger 30 is depressed the cam member 36 is withdrawn away from the cam bearer surface 119 so as to allow the rope to freely pass therebetween. This represents a novel and improved form of ascender cam which is not only applicable to the rope climbing device of the current invention, but to all rope climbing ascender cams. A further modification of the embodiment shown in FIG. 4 is the inclusion of a rope guide pin 124 to maintain the rope 12 in the path now shown. This pin 124 restrains the rope from moving into engagement with the cam member 36 when the device is used to lift low loads.

A further variation of the embodiment 10 shown in FIG. 4 is the modification to the karimber design, as best seen in FIG. 5, wherein an additional attachment mechanism is provided on top of the harness attachment member 42. This is provided by means of an extender plate 133 integrally formed with and extending vertically upwards (when viewed in FIG. 5) from the harness attachment member 42. This plate 133 is provided with a transversely extending hole 135 through which the rope 12 may be fed so as to provide a double pull loop arrangement of the rope as is conventional for winches. In this manner, and as illustrated in FIG. 4, prior to the rope 12 entering the device 10 as rope 12*a*, a first loop of the rope 12*c* is fed through the aperture 135 and extends vertically away from the device 10 around a remote pulley wheel before entering the climbing device 10 at position 12*a* in the manner described with reference to FIGS. 1-3. The rope 12*c* may extend to an anchor point remote the device or alternatively may be physically connected directly to the plate 133 dependent on the specific requirements. However, the provision of this additional loop of rope about a single pulley wheel would provide a lifting capability double that of the embodiment shown in FIG. 1 but will reduce the lifting speed by half. This is simply a modification that can optionally be employed so as to vary the lifting capacity of devices 10 of this type.

Whilst the foregoing description describes the use of a electronic power source in order to drive a gear reduction mechanism 18 and hence effect rotational displacement of the main pulley 20, it is equally feasible that the rotational output of the motor 14 could be replaced by a manual rotational force exerted by the user themselves, by use of an appropriate rotational handle mechanism whereby rotation of such a handle would then drive the appropriate gear mechanism 18 to provide an appropriate rotational output speed and torque to the pulley member 20. Such a manual device could be provided as a back-up to the electric motor for use when the motor fails or the battery power expires or could be used as an alternative to the motor.

In addition, whilst the preferred embodiment described herein utilises a portable power source in the form of a battery mounted in the device itself, it is also feasible that the electric motor may be driven by an alternative electric power source such as a battery pack carried by the user themselves and connected, by an umbilical cord, to the motor of the device. Alternatively, the device may be connected to a longer umbilical cord which may be connected to a stationery generator or even a mains power source. In a further alternative embodiment, it is equally feasible that a rope climbing device of this type could be powered by an internal combustion engine.

In addition, whilst the preferred mechanism discussed herein utilises an electromagnetic brake, many alternative forms of braking mechanism can be used which could be coupled either to the motor output shaft (as in the case of the electro magnetic brake) or even to the drive shaft directly. Alternatively, manual braking means could also be engageable directly with the pulley wheel itself. The simplest form of mechanical brake would include a ratchet pall, engageable with a toothed wheel rigidly and co-axially mounted on the drive shaft which would allow free rotation of the pulley wheel in a clockwise direction but, due to engagement between the tool wheel and such pall mechanism, would restrain rotation of the pulley wheel in an anti-clockwise direction thereby preventing descent of the apparatus 10 until such ratchet mechanism is manually released.

Alternatively, resiliently engageable frictional braking members could be releasably engaged with any of the pulley wheel 20, any of the gear wheels or the drive shafts of the configuration previously described. Such frictional braking members would be resiliently biased so as to effect a braking operation until such time that they are manually released.

An alternative or additional braking means could also be employed directly on the pulley wheel 20 or any of the gear wheels, so as to be activated in response to the detection of a pre-determined centrifugal force and hence activated in the event of a freefall situation. If, for some reason the other braking means on this type of climbing device were to fail then the weight of the user would result in a rapid displacement of the rope 12 through the pulley wheel 20 producing a high rotational speed of that pulley wheel. Pivotally mounted members on the wheel could then be employed to be radially displaced by the resultant centrifugal created by rotation of the pulley wheel above a pre-determined rotational speed, to then engage or otherwise activate an alternative braking means and to manually restrain continued rotation of the pulley 22. One example of such systems that could be readily included in the current device are the passive restraint systems utilised in motor vehicle seatbelt restraints employing such centrifugal braking mechanisms. The employment of such braking mechanisms directly on the pulley wheel itself will address potential difficulties should there be a catastrophic failure in the gear mechanism between the braked electric motor (as described) and such pulley wheel. As a yet further alternative, an electric magnetic brake could also be employed on the drive shaft on which such pulley is mounted to also address the potential difficulty of gearbox failure. Here again, the device of FIGS. 4 and 5 is fitted with a charging circuit 110 that functions as described above in connection with the device of FIGS. 1 to 3, to allow the motor 14 to be driven as a generator during descent, so as to charge the battery 16.

Furthermore, whilst the preferred embodiments rely on manual operation by a user suspended therefrom, such a device could easily be automated with the appropriate electronic circuit such that power to the motor could be activated remotely by use of an appropriate remote control device. This will allow the device to be used to transport inert loads up or down a rope as appropriate.

What is claimed is:

1. A portable power driven rope climbing apparatus comprising: a main support body; a power driven rotational input means mounted on said body; a drive shaft mounted on said body having a main pulley wheel co-axially mounted thereon; a gear reduction mechanism for transmitting a rotational force between said input means and said drive shaft; said main pulley wheel comprising engaging means for securely engaging a rope extending thereabouts such that rotation of said pulley wheel effects displacement of said rope; a rope input guide member and a rope output guide member for maintaining said rope in engagement with said pulley wheel about the majority of the pulley wheel circumference; and an attachment mechanism mounted on said main support body for releasably securing an external load thereto, and a rope entry guide member which supports said rope as it enters the apparatus and provides a fulcrum point about which the mass of the apparatus exerts a first moment, and wherein said attachment mechanism further comprises a seat member for suspending the load therefrom, said seat member being held remote from said main support body such that said load, when mounted thereon, exerts a second, opposed moment about said fulcrum, thereby causing pivotal displacement of the apparatus away from the load.

2. An apparatus as claimed in claim 1, wherein the rotational input means consists of one of electrical motor and rechargeable battery.

3. An apparatus according to claim 2, wherein said motor is controlled to drive said power driven rotational input means in a first direction to transmit a rotational force through said gear reduction mechanism and to rotate said main pulley wheel in a first rotational direction to effect displacement of said apparatus along said rope in a first direction and wherein displacement of said apparatus along said rope in an opposite direction causes said pulley wheel to be rotated in a second opposite direction for reversing the rotational direction of the input means, via said gear reduction mechanism, so as to adapt said motor to an electrical generator for recharging said battery.

4. An apparatus as claimed in claim 3, wherein said main pulley wheel has associated therewith an extractor member which is restrained from displacement relative to said pulley wheel and extends into said V shaped groove at a pre-determined position about its axis to engage and deflect said rope out of engagement with said groove during rotation of said pulley wheel.

5. An apparatus as claimed in claim 4, wherein said main support body comprises a main chassis and a displaceable cover releasably connected to said chassis, wherein said drive shaft is operatively mounted between and supported by said chassis and said displaceable cover when said cover is connected thereto.

6. An apparatus as claimed in claim 5, wherein said drive shaft has a first end secured from displacement relative to said chassis and said displaceable cover has a bearing mechanism for releasably engaging an opposed end of said drive shaft when said cover is connected to said chassis.

7. An apparatus as claimed in claim 5, wherein each of the rope input guide member and rope output guide member are mounted between and supported by said chassis and displaceable cover member when said cover is connected thereto.

8. An apparatus as claimed in claim 7, wherein said attachment mechanism comprises a rigid loop member projecting outwardly from said main support body and secured from displacement relative thereto.

9. An apparatus as claimed in claim 8, wherein said attachment mechanism comprises a releasable gate member for selectively opening or closing a channel through an outer wall of said loop member to allow a connector element of said load to be passed through said channel to engage with and be supported by said loop member.

10. An apparatus as claimed in claim 9, wherein said displaceable cover has an arrangement which is received through said channel when said cover is connected to said chassis, so that when said gate member closes said channel, said closed gate member serves to restrain said cover from displacement away from said chassis.

11. An apparatus as claimed in 3, wherein said power driven rotational input means has a first rotational axis and said drive shaft has a second rotational axis extending parallel to and remote from said first rotational axis, with said gear reduction mechanism extending transversely between said first and second axis.

12. An apparatus as claimed in claim 3, wherein said main pulley wheel comprises engaging means on at least one of its inwardly directed side walls.

13. An apparatus as claimed in claim 12, wherein said engaging means comprise a plurality of radially extending ridges and grooves.

14. An apparatus as claimed in claim 13, wherein a plurality of holes are formed in the inner surface of walls into which the rope can flow as it becomes compressed in a V shaped groove.

15. An apparatus as claimed in claim 12, wherein side walls of said main pulley are defined by an array of radially extending arm members.

16. An apparatus as claimed in claim 2, further comprising a brake mechanism for selectively restraining rotation of said power driven rotational input means.

17. An apparatus as claimed in claim 16, wherein said brake mechanism comprises an electromagnetic brake which restrains rotation of said rotational input when said brake and said motor are switched off, and which releases said power driven rotational input means for rotation when said brake and said motor are switched on.

18. An apparatus as claimed in claim 1, wherein said engaging means comprises a circumferential V shaped groove for frictionally engaging said rope compressed therein.

19. An apparatus as claimed in claim 18, wherein inwardly directed side walls of said V shaped groove define an angle of between 5 and 35 degrees.

20. An apparatus as claimed in claim 19, wherein said angle lies between 5 and 20 degrees.

21. An apparatus as claimed in claim 1, wherein said rotational input means is driven alternatively.

22. An apparatus as claimed in claim 1, further comprising a rope restraint mechanism biased into engagement with said rope to restrain displacement of said rope relative to said apparatus in a first direction, whilst allowing said relative displacement of the rope in a second opposite direction.

23. An apparatus as claimed in claim 22, wherein said restraint mechanism is manually displaceable from a first position biased into engagement with said rope to a second position out of engagement with said rope to allow displacement of said rope relative to said apparatus in either direction when in said second position.

24. An apparatus as claimed in claim 23, further comprising a manually displaceable switch member for operating said power driven rotational input means, wherein said switch member is operatively coupled with said restraint mechanism such that manual displacement of said switch member from a first to a second position effects corresponding displacement of said restraint mechanism from said first to said second position.

25. An apparatus as claimed in claim 22, wherein said restraint mechanism comprises an ascender cam.

26. An apparatus as claimed in claim 25, wherein the ascender cam comprises a rotatably mounted cam member pivotally biased towards a cam bearer for compression of said rope passing therebetween and the cam bearer has a rope engaging surface of complimentary shape to that of a rope engaging surface of said cam member.

27. An apparatus as claimed in claim 26, wherein said rope engaging surface of said cam member is convex and wherein said cam bearer has a complimentary concave surface.

28. An apparatus as claimed in claim 26, wherein said rope engaging surface of said cam bearer is adapted for increasing frictional engagement with said rope disposed between the cam bearer and the cam member.

29. An apparatus as claimed in claim 1, wherein the attachment mechanism is mounted towards an upper portion of the apparatus so that, in use, when the apparatus is attached to a user's harness in the region of the user's sternum, the bulk of the apparatus will be disposed below the user's sternum in the vicinity of the user's lap.

30. A portable power driven rope climbing apparatus comprising:

a main support body; a power driven rotational input means mounted on said body; a drive shaft mounted on said body having a main pulley wheel co-axially mounted thereon; a gear reduction mechanism for transmitting a rotational force between said input means and said drive shaft; said gear reduction mechanism comprises a spur gear mechanism; said main pulley wheel comprising engaging means for securely engaging a rope extending thereabouts such that rotation of said pulley wheel effects displacement of said rope; a rope input guide member and a rope output guide member for maintaining said rope in engagement with said pulley wheel about the majority of the pulley wheel circumference; an attachment mechanism mounted on said main support body for releasably mounting an external load thereon, and a rope entry guide member supporting said rope as it enters the apparatus and providing a fulcrum point about which the mass of the apparatus exerts a first moment, and wherein said attachment mechanism further comprises a seat member for suspending said load therefrom, said seat member being held remote from said main body such that said load, when mounted thereon, exerts a second, opposed moment about said fulcrum.

31. A portable power driven rope climbing apparatus comprising:

a main support body; a power driven rotational input means mounted on said body; a drive shaft mounted on said body having a main pulley wheel co-axially mounted thereon; a gear reduction mechanism for transmitting a rotational force between said input means and said drive shaft; said main pulley wheel comprising engaging means for securely engaging a rope extending thereabouts such that rotation of said pulley wheel effects displacement of said rope; a rope input guide member and a rope output guide member for maintaining said rope in engagement with said pulley wheel about the majority of the pulley wheel circumference; and an attachment mechanism mounted on said main support body for releasably securing an external load thereto, and a rope entry guide member supporting said rope as it enters the apparatus and providing a fulcrum point about which the mass of the apparatus exerts a first moment, and wherein said attachment mechanism further comprises a seat member for suspending said load therefrom, said seat member being held remote from said main body such that said load, when mounted thereon, exerts a second, opposed moment about said fulcrum, at least one of said input guide member and said rope output guide member comprises a rotatable pulley wheel rotatable in a first direction and restrained from displacement in a second opposed direction.

* * * * *